US006357852B1

(12) United States Patent
Premnath et al.

(10) Patent No.: US 6,357,852 B1
(45) Date of Patent: Mar. 19, 2002

(54) METHOD AND APPARATUS FOR RESTORING AN INK JET PRINTHEAD

(75) Inventors: Karai P. Premnath; Stanley Dabrowny; William L. King, all of Rochester, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/098,313

(22) Filed: Jun. 16, 1998

(51) Int. Cl.[7] ..... B41J 2/165
(52) U.S. Cl. ..... 347/35; 347/23
(58) Field of Search ..... 347/35, 29, 23, 347/11, 15, 19; 358/296

(56) References Cited

U.S. PATENT DOCUMENTS

| | | | | |
|---|---|---|---|---|
| 4,571,599 A | | 2/1986 | Rezanka | 347/87 |
| 4,638,337 A | | 1/1987 | Torpey et al. | 347/65 |
| 4,679,059 A | | 7/1987 | Dagna | 347/50 |
| RE32,572 E | | 1/1988 | Hawkins et al. | 137/68.19 |
| 4,746,938 A | | 5/1988 | Yamamori et al. | 347/28 |
| 4,849,774 A | | 7/1989 | Endo et al. | 347/56 |
| 4,853,717 A | | 8/1989 | Harmon et al. | 347/29 |
| 4,855,764 A | | 8/1989 | Humbs et al. | 347/31 |
| 4,970,527 A | | 11/1990 | Gatten | 347/23 |
| 5,182,580 A | * | 1/1993 | Ikeda et al. | 347/19 |
| 5,353,051 A | * | 10/1994 | Katayama et al. | 347/13 |
| 5,530,462 A | * | 6/1996 | Takahashi et al. | 347/23 |
| 5,805,182 A | * | 9/1998 | Lee | 347/35 |
| 6,024,432 A | * | 2/2000 | Aruga et al. | 347/23 |

* cited by examiner

*Primary Examiner*—N. Le
*Assistant Examiner*—Shih-Wen Hsieh
(74) *Attorney, Agent, or Firm*—David J. Arthur

(57) ABSTRACT

A printhead priming operation is described which provides an improved restoration of a thermal ink jet printhead following a capping operation. In one embodiment, a printhead is moved to a capping position following a print operation. A timing sequence is initiated in which the resistors are addressed by a partial tone firing pattern. At a later time interval, the resistors are addressed by a full tone firing pattern followed by another partial tone firing pattern. This firing sequence maintains the printhead nozzles free of contaminants while lessening air bubble formation within the printhead channels and ink reservoir. Upon resumption of print operation, the printhead begins printing at a lower temperature achieved during the partial tone firing.

16 Claims, 5 Drawing Sheets

METHOD AND APPARATUS FOR RESTORING AN INK JET PRINTHEAD

BACKGROUND OF THE INVENTION AND MATERIAL DISCLOSURE STATEMENT

The invention relates to a method and apparatus for restoring ink jet printhead performance following a period in which the printhead has been capped. More particularly, the invention is directed to a method and apparatus for printhead the printhead, while in a capped position, by applying at least a first full tone firing pattern to the printhead followed by a second, partial tone, firing pattern.

An ink jet printer of the so-called "drop-on-demand" type has at least one printhead from which droplets of ink are directed towards a recording medium. Within the printhead, the ink may be contained in a plurality of channels where power pulses are used to cause the droplets of ink to be expelled, as required, from orifices or nozzles at the ends of the channels.

In a thermal ink jet printer, the power pulses that result in a rapidly expanding gas bubble to eject the ink from the nozzle are usually produced by resistors, each located in a respective one of the channels, which are individually addressable by voltage pulses (firing) to heat and vaporize ink in the channels. As voltage is applied across a selected resistor, a vapor bubble grows in that particular channel and ink bulges from the channel orifice. At that stage, the bubble begins to collapse. The ink within the channel retracts and separates from the bulging ink which forms a droplet moving in a direction away from the channel orifice and towards the recording medium. The channel is then re-filled by capillary action, which in turn draws ink from a supply container. Operation of a thermal ink jet printer is described in, for example, U.S. Pat. No. 4,849,774.

One particular form of thermal ink jet printer is described in U.S. Pat. No. 4,638,337. That printer is of the carriage type and has a plurality of printheads, each with its own ink supply cartridge, mounted on a reciprocating carriage. The nozzles in each printhead are aligned perpendicular to the line of movement of the carriage and a swath of information is printed on the stationary recording medium as the carriage is moved in one direction. The recording medium is then stepped, perpendicularly to the line of carriage movement, by a distance equal to the width of the printed swath. The carriage is then moved in the reverse direction to print another swath of information.

It has been recognized that there is a need to maintain the ink ejecting nozzles of an ink jet printer, for example, by periodically cleaning the orifices when the printer is in use, and/or by capping the printhead when the printer is out of use or is idle for extended periods. The capping of the printhead is intended to prevent the ink in the printhead from drying out. There is also a need to prime a printhead before use, to ensure that the printhead channels are completely filled with ink and contain no contaminants or air bubbles and also periodically to maintain proper functioning of the nozzles. This priming procedure is referred to as restoring the printhead to optimum printing status. Maintenance and/or priming stations for the printheads of various types of ink jet printer are described in, for example, U.S. Pat. Nos. 4,855,764; 4,853,717 and 4,746,938 while the removal of gas from the ink reservoir of a printhead during printing is described in U.S. Pat. No. 4,679,059.

One priming method for removing dried contaminants is to utilize a full tone firing in which all of the resistor heaters of a printhead are sequentially addressed (fired) once, or a number of times. The first resistor in a row is pulsed with each adjacent resistor being pulsed until all the resistors in a row have been pulsed, the complete row pulsing is referred to as a stroke. The printhead may be addressed by a plurality of full tone firings or strokes. U.S. Pat. No. 4,970,527 discloses such a system in which full tone priming is accomplished after a predetermined amount of time has elapsed since the last printing command.

A problem with this type of prior art full tone priming method is that because of the high frequency firing, the temperature of the printhead substrate heats up very quickly creating two undesirable phenomena. One is an increase in the number of air bubbles formed in the printhead ink reservoir. These air bubbles, if not removed, can create undesirable defects in the output prints. A second is that the printhead, if rapidly returned to the print mode, begins print operation at an undesirably high temperature, resulting in stress to the printhead substrate.

SUMMARY OF THE INVENTION

It is, therefore, an object of the invention to restore an ink jet printhead to an optimum print state by an improved priming operation which results in elimination of contaminants at the printhead nozzles while suppressing the formation of air bubbles in the printhead reservoir.

It is a further object of the invention to restore the printhead to a print mode at a lower, less stressful, temperature level.

It is a still further object to perform the improved priming operation at an optimum time period following initiation of a capping routine.

These, and other objects of the invention, are accomplished by applying a full tone firing pattern to the resistors of a printhead following a predetermined event, in the preferred embodiment, a capping function. The full tone firing pattern is then followed by a fractional tone firing pattern. For a fractional, or partial tone firing, the first resistor in a row is pulsed, followed by pulsing of non-adjacent resistors in a specified sequence. The first stroke, thus, fires only some of the resistors in the row. The second and subsequent firings are directed to resistors previously not fired, again in a preset sequence. By using the combination of a full tone firing followed by a partial tone firing, it has been found that air bubble formation is reduced. As a further desirable result, the fractional tone firing pattern produces a "cool down" period for the printhead before it is returned to print operation, resulting in less stress on the printhead and increased printhead life.

More particularly, the present invention relates to a method of restoring a printer, the printer including a printhead with a plurality of transducers and associated channels and ink ejecting nozzles, comprising the steps of:

moving the printhead into a capping condition, addressing the transducers with a full tone firing sequence to create a, full tone priming where ink is ejected from said nozzles in a high density pattern and addressing the transducers with a partial tone firing sequence to create a partial tone priming where ink is ejected from said nozzles in a low density pattern and whereby the printhead nozzles are cleared of contaminants during application of the full tone firing, and air bubbles are removed from the printhead during application of the partial tone firing.

DESCRIPTION OF THE INVENTION

Figure 1:
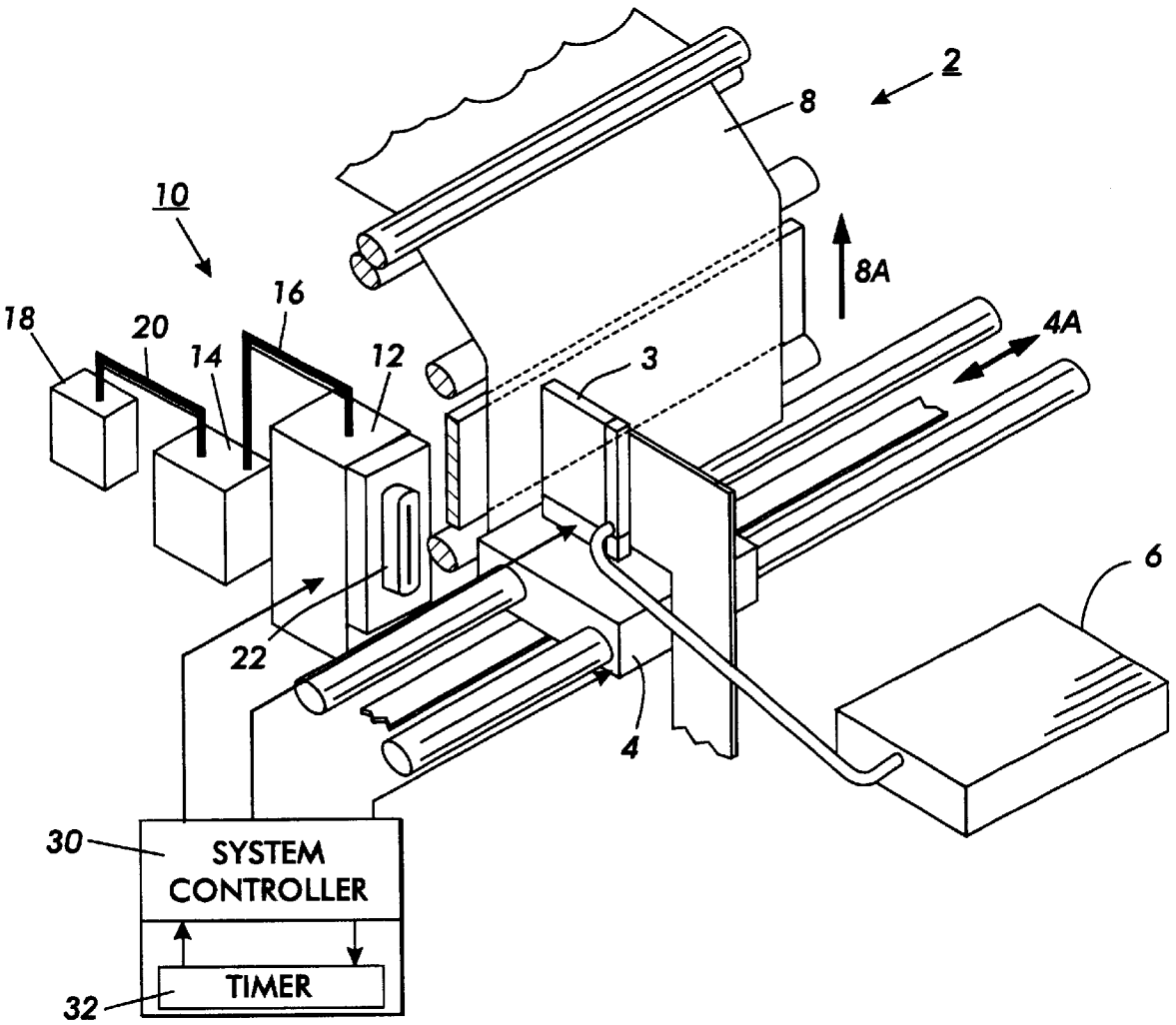
FIG. 1 is a schematic perspective view of a thermal ink jet printhead.
Figure 2:
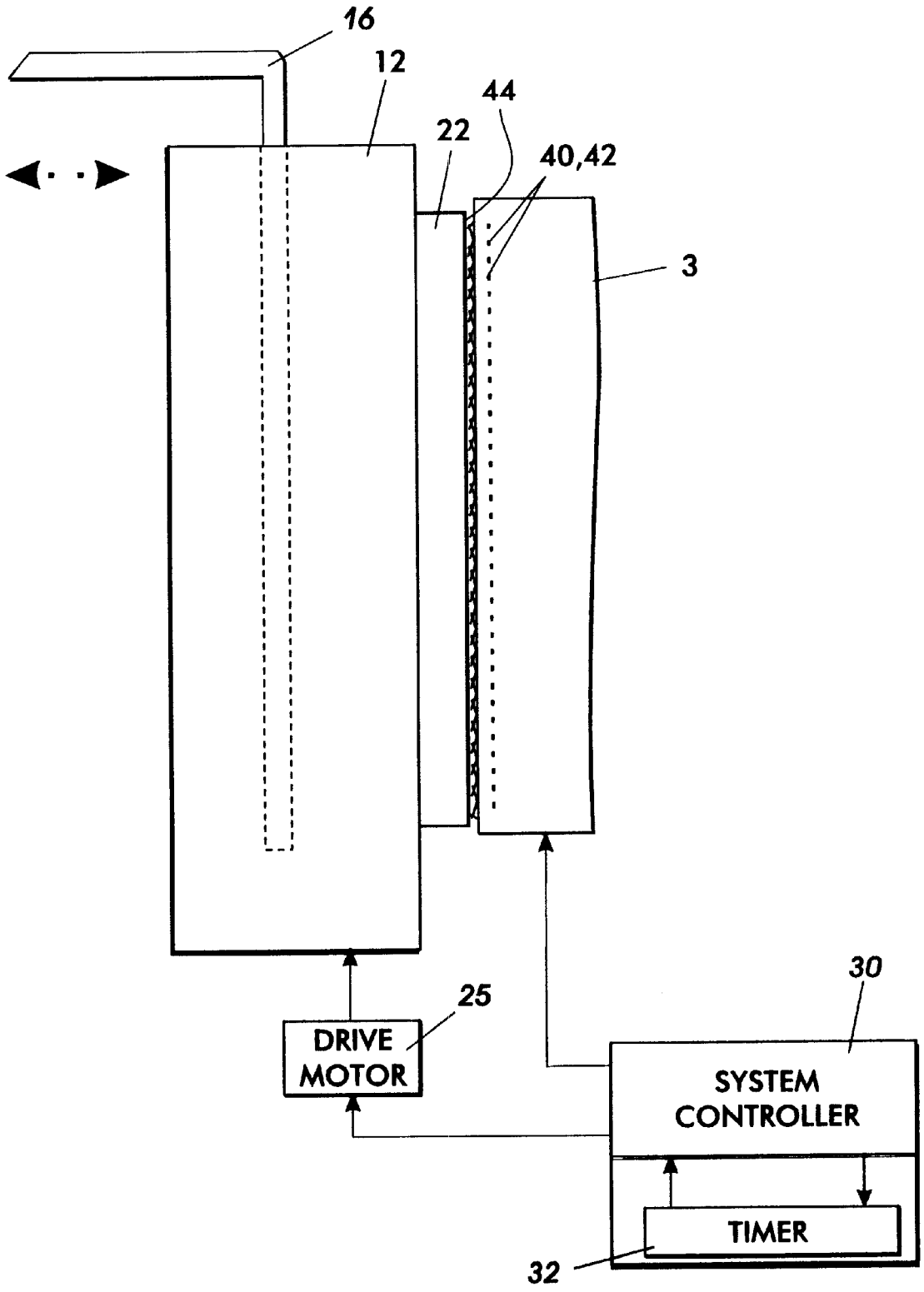
FIG. 2 is a side view of the printhead of FIG. 1 in a capped position.

The printer 2 shown in FIG. 1 has a printhead 3 mounted on a carriage 4 connected to receive ink from a supply container 6. The printhead 2 contains a plurality of ink channels (not shown in FIG. 1) which carry ink from the supply container 6 to respective ink ejecting orifices or nozzles 42 (FIG. 2). When printing, the carriage 4 reciprocates back and forth across the page as indicated by the arrow 4A. Droplets of ink are expelled from selected ones of the printhead nozzles by firing of selected resistors 40 (FIG. 2) in the printhead as described below and are directed towards a recording medium 8 which can be a cut sheet of paper, a web of paper, or other material. During each pass of the carriage 4, the recording medium 8 is stationary. At the end of each pass, however, the recording medium 8 is stepped in the direction of the arrow 8A. For a more detailed explanation of the printhead and printing thereby refer to U.S. Pat. No. 4,571,599 and U.S. Pat. No. Reissue 32,572 incorporated herein by reference.

At one side of the printer outside the printing zone is a priming/maintenance station 10. At the completion of a printing operation, the printhead carriage 4 is parked in a location within the priming maintenance station 10. The priming maintenance station 10 includes a capping member 12 which is coupled to an ink trap 14 through a first line 16. The ink trap 14 is coupled to a suction pump 18 through a second line 20. The suction pump 18 applies a negative pressure or a vacuum to the capping member 12 through the lines 20, 16 and also through the ink trap 14. The ink trap 14 traps any ink or other debris which is drawn by the capping member 12 during a priming or maintenance operation.

When the carriage 4 is parked within the priming/maintenance station 10, the capping member 12 is moved towards the printhead 3 until the priming element 22, which is coupled to the capping member 12, contacts the printhead 2. Once in contact, the priming element 22 is sealed against the front face of the printhead 2, thereby surrounding the ink ejecting nozzles.

The operation of printer 2 is conventionally controlled by a system controller 30. Controller 30 controls the movement of carriage 4, the firing of the resistors, the movement of the capping member 12 and operation of the suction pump 18. Controller 32 also contains a timer 32 for purposes described below.

Figure 3:
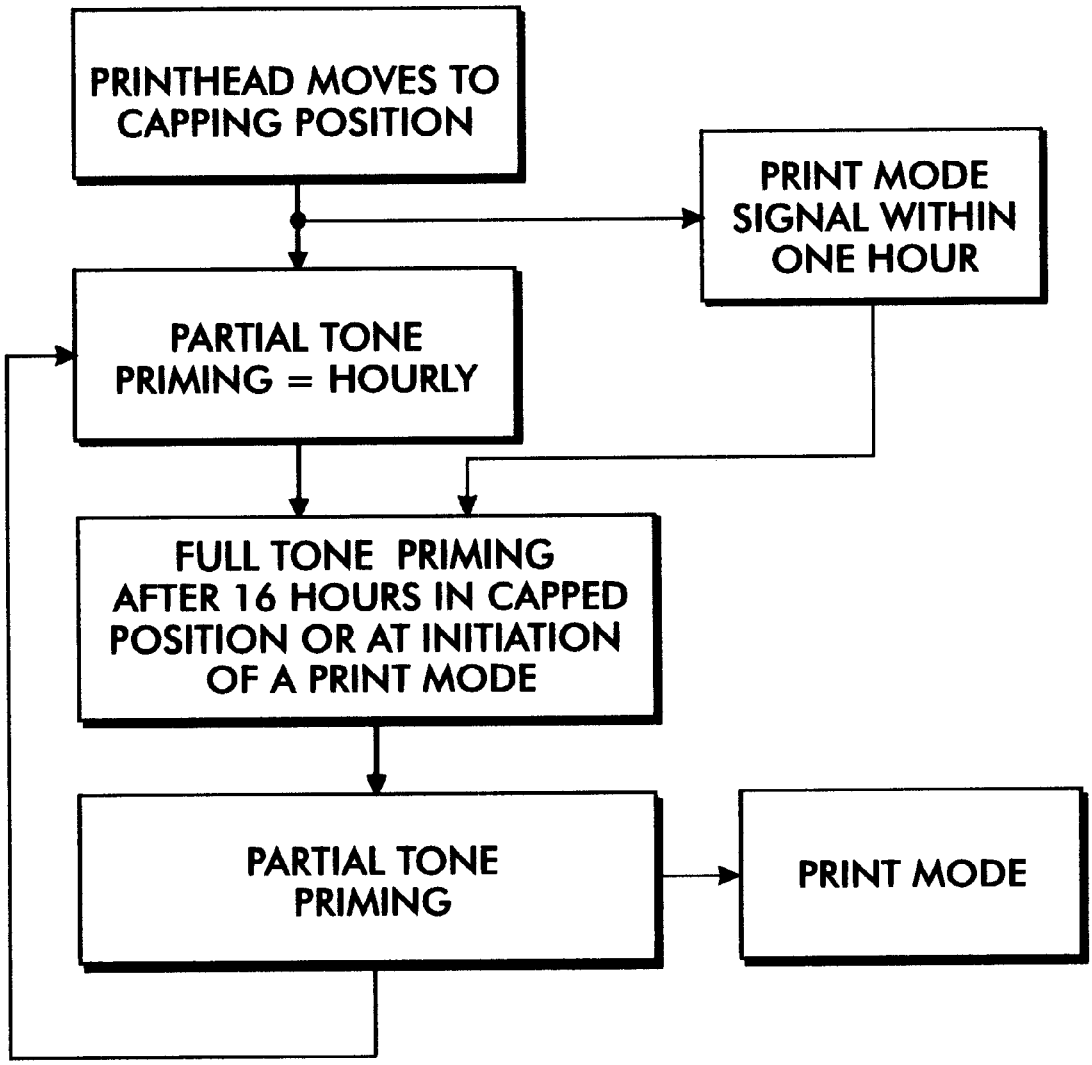
FIG. 3 shows one embodiment of the invention in a flow chart format
Figure 4:
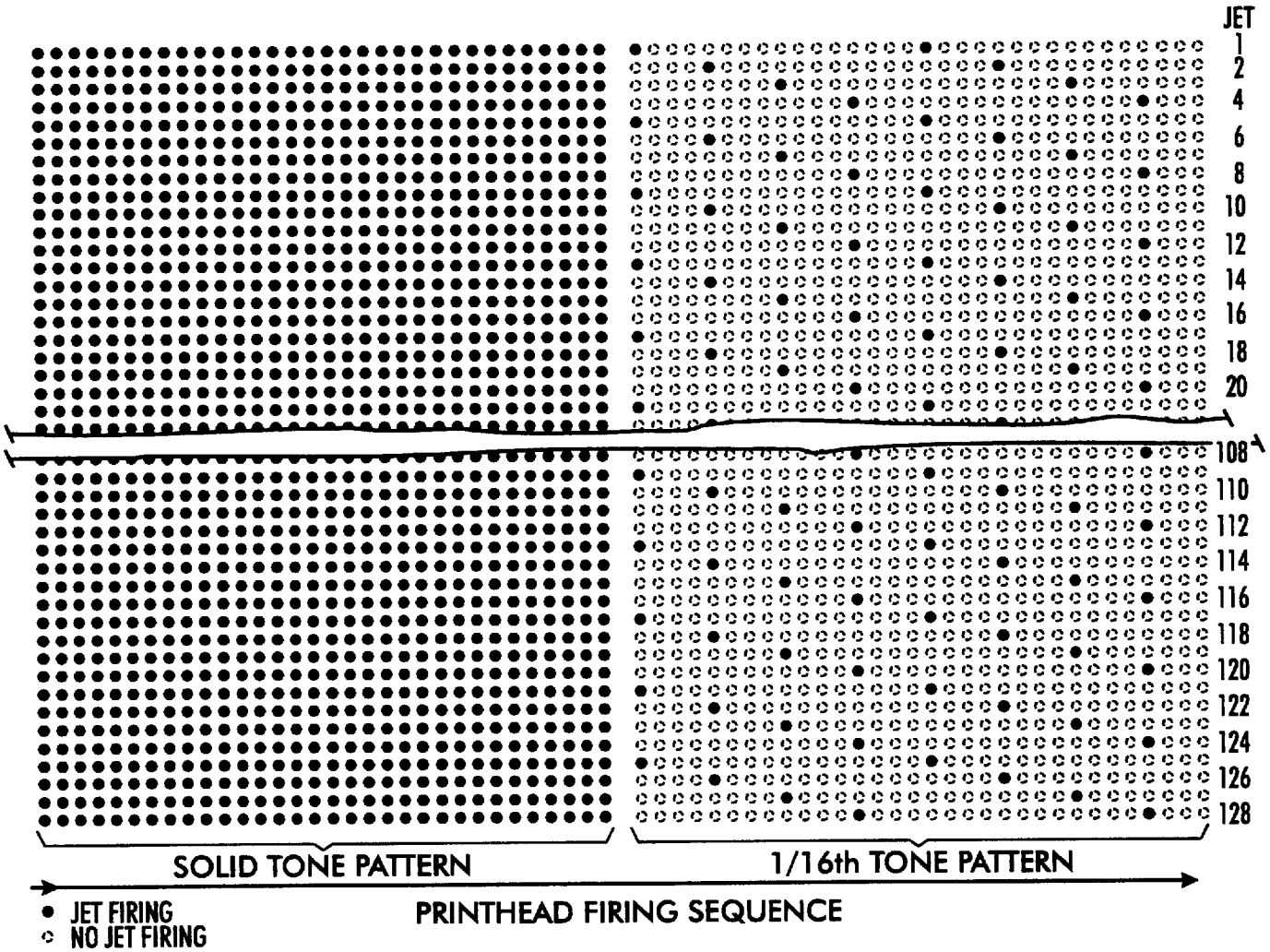
FIG. 4 is a representation of a full tone and a 1/16 tone density pattern created by ink ejection onto a record medium.

In a first example of the priming method of the present invention, it is assumed that a print operation has been concluded and the carriage and printhead are to be parked at the maintenance station 10. FIG. 2 shows a partial side view of the maintenance station showing capping member 12 following movement into a coupling (capped) position with respect to printhead 3. The member 12 can be moved by a drive motor 25 controlled by signals from controller 30. Initiation of capping motion is conventionally created by the printhead 3 activating a switch during movement into the maintenance station. It is assumed that printhead 3 has a single row of 128 resistors 40, each resistor with an associated channel 42 and nozzle 44. The signal to start motor 25 is accompanied by a signal generated internally of the controller which is sent to timer 32 activating a timing circuit. Referring to FIG. 3, a timing algorithm controls the priming operation from this point. In the present example, if the printhead remains capped (in a non-print mode) after one hour has elapsed, signals from timer 32 to controller 30 causes the printhead to be primed by application of a partial tone firing controlled by controller 30. For this example, a 1/16 tone firing is created in which every fifth resistor is fired during a first stroke time period. Several stroke periods elapse followed by a second stroke in which the second resistor in the row is fired followed by firing of every fifth resistor. This sequence is continued until all the resistors have been fired at least once but preferably a number of times. It will be appreciated that the effect is that of a firing of all the resistors at a low frequency. The resistors heat the ink in the associated channels causing drop ejection through nozzles 44 into the body of member 12 where the ink collects until removal into ink trap 14. This partial tone priming is repeated every hour until one of two events occurs. Upon lapse of a predetermined time, 16 hours from entering the capped position for this example, or upon receipt of a print mode signal at any time, a full tone priming occurs in which all the resistors 40 are fired sequentially for a plurality of strokes. Full tone priming may be initiated also in the case where a print mode signal is received less than one hour after entering the capped position. Once the full tone priming is completed, a partial tone priming is implemented. In the absence of a print signal, the routine is continued. The result of the full tone/partial tone firing sequence is that any contaminant buildup either in the channels or nozzles is removed by the full tone firing, and air bubbles are reduced by the partial tone firing. Further, if the printhead is returned to a print mode soon after the full tone firing, the partial tone firing will allow the printhead to begin operation at a cooler, less stressful state. FIG. 4 is a representation of the full tone and partial tone firings when accomplished onto a recording medium rather than into the capping member. The printhead firing sequence progresses from a solid tone pattern at the left to a partial tone (1/16 pattern) on the right. It will be apparent that the full tone firing produces a high frequency firing creating a high density ink output pattern. The partial tone pattern forms a dot pattern which is effectively a low frequency firing creating a low density ink output pattern.

Figure 5:
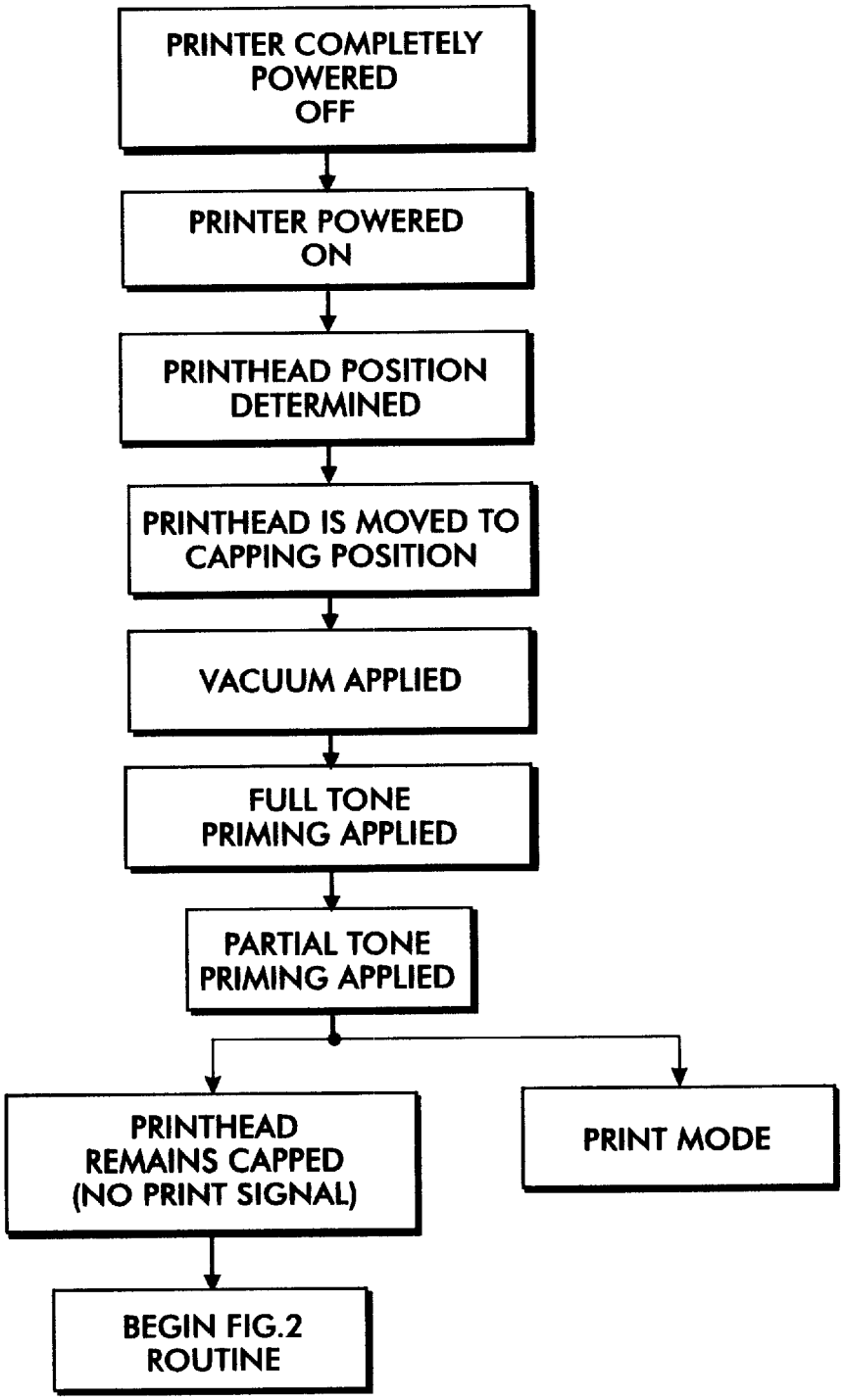
FIG. 5 shows another embodiment of the invention in a flow chart format.

The above description of the firing algorithm shown in FIG. 3 assumed that the printhead was placed into the capping position following completion of a print mode. The printhead can also be placed into the capping position following a partial, or soft, printer shutdown in which power is reduced to a standby status. Power is maintained, however, to perform the firing sequence shown in FIG. 3. The invention also contemplates a complete power shutdown of a printer either purposefully or catastrophically. This may result in the printhead being stranded at a location outside the maintenance station. Referring to FIG. 5, a complete powering off of the printer is followed at some power of time by power restoration (printer powered on). Controller 30 initiates an algorithm which determines the current location of the printhead and, if not within the capping position, moves it there. A vacuum is applied to the printhead nozzles followed by full tone priming and a partial tone priming. In the absence of a print signal, the printhead remains capped, and the FIG. 2 routine commences. If a print signal is received, the printhead returns to a print mode of operation.

From the above, it will be understood that, according to the principles of the invention, the printhead is maintained in a condition to begin an optimum print operation (at a reduced temperature and with reduced bubbles in the ink reservoir) by providing, at least a full tone priming followed by a partial tone priming While a full tone and a 1/16 tone firing has been specified, other tone firing ratios may be used consistent with the principles of the invention as long as the firing which creates the high density pattern accomplishes the task of removing most of the contaminant buildup and the firing which creates the low density pattern clears air bubbles and allows the printhead to cool down.

Although the priming method has been disclosed in the context of a thermal ink jet printhead where the transducers are resistors, it will be appreciated that the method is applicable to other types of printheads such as piezoelectric printheads. In this case, the controller controls operation of the transducers associated with the piezoelectric transducers associated with the nozzle ejection. The printhead disclosed above is of the "side shooter" type where ink is ejected from the sides of a channel. However, the invention is equally applicable to a roofshooter type of printhead.

While the embodiment disclosed herein is preferred, it will be appreciated from this teaching that various alternative, modifications, variations or improvements therein may be made by those skilled in the art, which are intended to be encompassed by the following claims:

What is claimed is:

1. A method of restoring a printer, the printer including a printhead with a plurality of transducers and associated channels and ink ejecting nozzles, comprising the steps of:

moving the printhead into a capping condition, addressing the transducers with a full tone firing sequence to create a full tone priming where ink is ejected from said nozzles in a high density pattern and addressing the transducers with a partial tone firing sequence to create a partial tone priming where ink is ejected from said nozzles in a low density pattern and whereby the printhead nozzles are cleared of contaminants during application of the full tone firing, and air bubbles are removed from the printhead during application of the partial tone firing.

2. The method of claim 1 wherein the printer is an ink jet printer and the transducers are resistors.

3. The method of claim 1 including the further step of addressing the transducers with a partial tone firing sequence at a present time interval measured from initiation of movement to the capping position.

4. The method of claim 1 including the further step of moving the printhead into a print zone following said partial tone firing sequence.

5. A method of maintaining a printhead, wherein the printhead comprises a plurality of ink ejecting nozzles, the method comprising:

ejecting ink from a first plurality of the ink ejecting nozzles;

ejecting ink from a second plurality of the ink ejecting nozzles, wherein the second plurality of ink ejecting nozzles comprises a predetermined subset of the first plurality of ink ejecting nozzles.

6. The method of claim 5, additionally comprising: ejecting ink from a third plurality of the ink ejecting nozzles, wherein:

the third plurality of ink ejecting nozzles comprises a predetermined subset of the first plurality of ink ejecting nozzles; and the third plurality of ink ejecting nozzles is different from the second plurality of ink ejecting nozzles.

7. The method of claim 5, additionally comprising:

capping the printhead before ejecting ink from either the first plurality of the ink ejecting nozzles or the second plurality of the ink ejecting nozzles.

8. A method of maintaining a printhead, wherein the printhead comprises a plurality of ink ejecting nozzles, the method comprising:

capping the printhead;

at a first predetermined time after capping the printhead:

ejecting ink from a first set of the ink ejecting nozzles during a first time period; and ejecting ink from a second set of the ink ejecting nozzles, during a second time period, wherein:

the nozzles of the second set of the ink ejecting nozzles are different from the nozzles of the first set of the ink ejecting nozzles;

the second time period is of substantially the same duration as the first time period; and the second time period is subsequent to the first time period;

at a second predetermined time after capping the printhead:

ejecting ink from the first and second sets of the ink ejecting nozzles during a third time period, wherein:

the third time period is of substantially the same duration as the first time period.

9. The method of claim 8, wherein the second predetermined time after capping the printhead is the first to occur of either:

a predetermined elapsed time; or the receipt of a print mode signal.

10. The method of claim 8, wherein:

the first predetermined time after capping the printhead is a first predetermined elapsed time; and the second predetermined time after capping the printhead is the first to occur of either:

a second predetermined elapsed time; or the receipt of a print mode signal.

11. The method of claim 8, additionally comprising, at the first predetermined time, ejecting ink from the first set of nozzles during a fourth time period, wherein:

the fourth time period is of substantially the same duration as the first time period; and the fourth time period is subsequent to the second time period.

12. An ink jet printer, comprising:

a printhead having a plurality of ink ejecting nozzles;

a fluid supply connected to the printhead to supply ink to the ink ejecting nozzles;

a controller connected to the printhead for selectively causing the ink ejecting nozzles to eject fluid, wherein the controller is configured to cause:

at first predetermined time intervals, successive sets of the ink ejecting nozzles to eject fluid; and at second predetermined time intervals, a plurality of the sets of ink ejecting nozzles to eject fluid.

13. The ink jet printer of claim 12, wherein the controller is configured to cause at the first predetermined time intervals:

a first set of the ink ejecting nozzles to eject ink during a first time period; and a second set of the ink ejecting nozzles to eject ink during a second time period, wherein:

the nozzles of the second set of the ink ejecting nozzles are different from the nozzles of the first set of the ink ejecting nozzles;

the second time period is of substantially the same duration as the first time period; and the second time period is subsequent to the first time period.

14. The ink jet printer of claim 13, wherein the controller is further configured to cause at the second predetermined time intervals:

the first and second sets of the ink ejecting nozzles to eject ink during a third time period, wherein:

the third time period is of substantially the same duration as the first time period.

15. The ink jet printer of claim 14, wherein the first predetermined time interval is shorter in duration than the second predetermined time interval.

16. The ink jet printer of claim 12, wherein:

the printhead is movable;

the printer additionally comprises a capping mechanism for capping the printhead; and the controller moves the printhead adjacent the capping mechanism and causes the capping mechanism to cap the printhead.

* * * * *